US005639108A

United States Patent [19]

Challande et al.

[11] Patent Number: 5,639,108

[45] Date of Patent: Jun. 17, 1997

[54] BOOT-RETENTION ELEMENT ASSEMBLY, PARTICULARLY FOR SKIING

[75] Inventors: Christian Challande, Cruseilles; Pierre Desarmaux, Evires; Pascal Thomas, Chambery, all of France

[73] Assignee: Salomon S.A., Metz-Tessy, France

[21] Appl. No.: 501,860

[22] Filed: Jul. 13, 1995

[30] Foreign Application Priority Data

Jul. 13, 1994 [FR] France ..... 94 08942

[51] Int. Cl.[6] ..... A63C 9/086

[52] U.S. Cl. ..... 280/629; 280/633; 280/607; 280/613

[58] Field of Search ..... 280/626, 625, 280/629, 633, 607, 613

[56] References Cited

U.S. PATENT DOCUMENTS

| | | | |
|---|---|---|---|
| 3,947,051 | 3/1976 | Sittmann . | |
| 4,352,508 | 10/1982 | Spademan | 280/624 |
| 4,824,293 | 4/1989 | Rochard | 280/615 |

FOREIGN PATENT DOCUMENTS

| | | |
|---|---|---|
| 1503847 | 12/1967 | France . |
| 1503848 | 12/1967 | France . |
| 1503849 | 12/1967 | France . |
| 2218913 | 9/1974 | France . |
| 1807074 | 5/1970 | Germany . |
| 2449514 | 4/1976 | Germany . |

*Primary Examiner*—Brian L. Johnson
*Assistant Examiner*—Avraham Lerner
*Attorney, Agent, or Firm*—Greenblum & Bernstein P.L.C.

[57] ABSTRACT

An assembly of a boot and a binding for a gliding board, such as a ski, as well as the boot and binding themselves. The binding has a movable mechanical mechanism for enabling a modification of the release threshold of the binding at will. The boot has a local reference which differs according to whether the boot is for the right or left side. The binding has movable sensors and a linkage to affect the release threshold of the binding. The reference of the boot determines the side of the jaw for which the release threshold is modified.

28 Claims, 9 Drawing Sheets

36
30
32
34
11
16
38
2
6
1

10
31
25
29
8
20
33
26
28
27
34
30
32
19
21
36
38
11

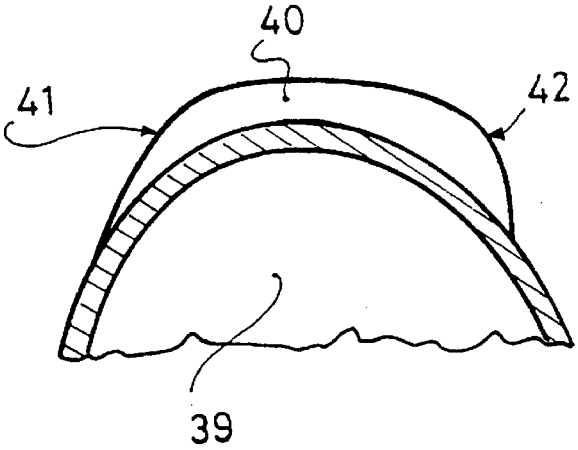
Fig: 6
Fig: 9
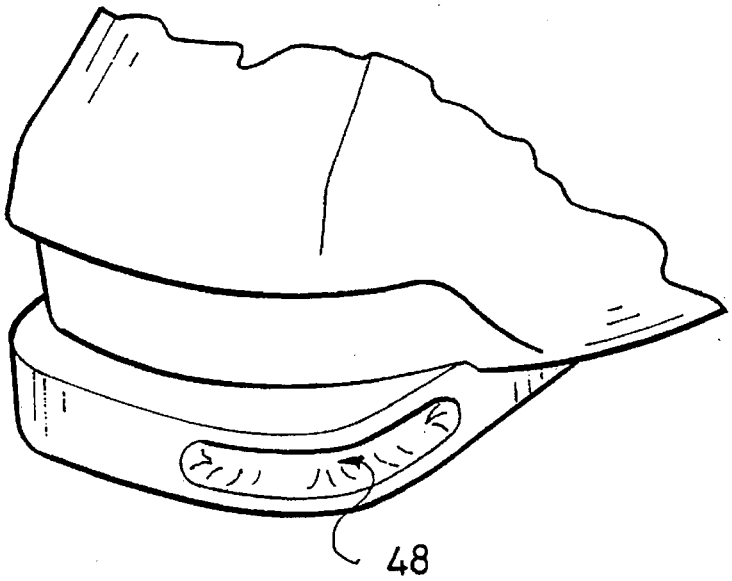
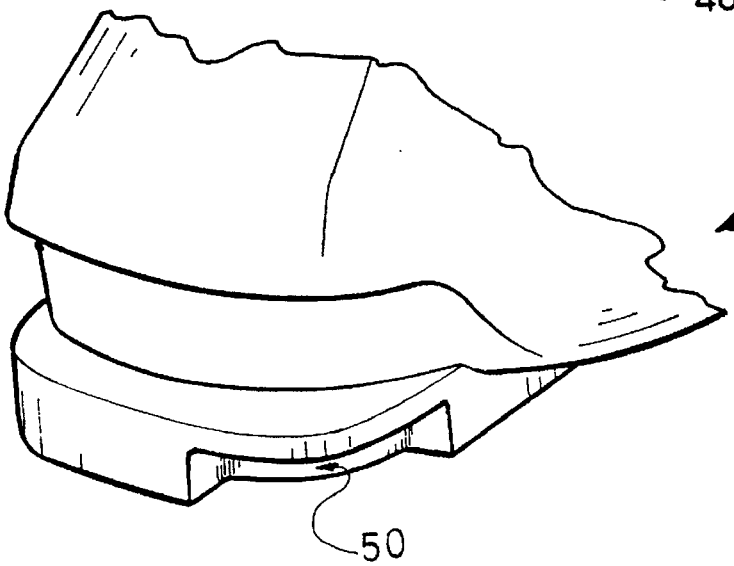
Fig: 10

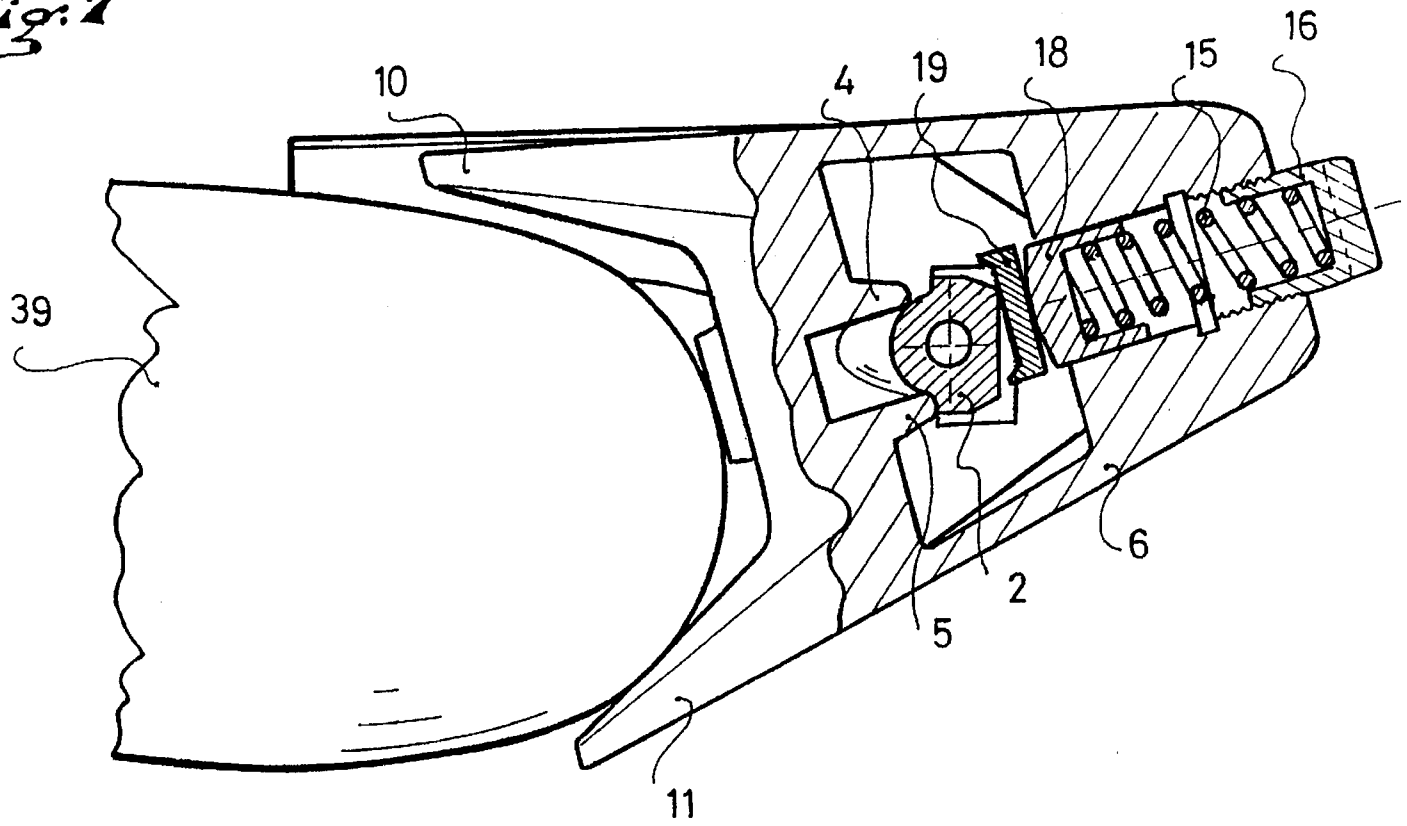
Fig. 7
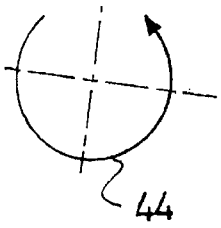

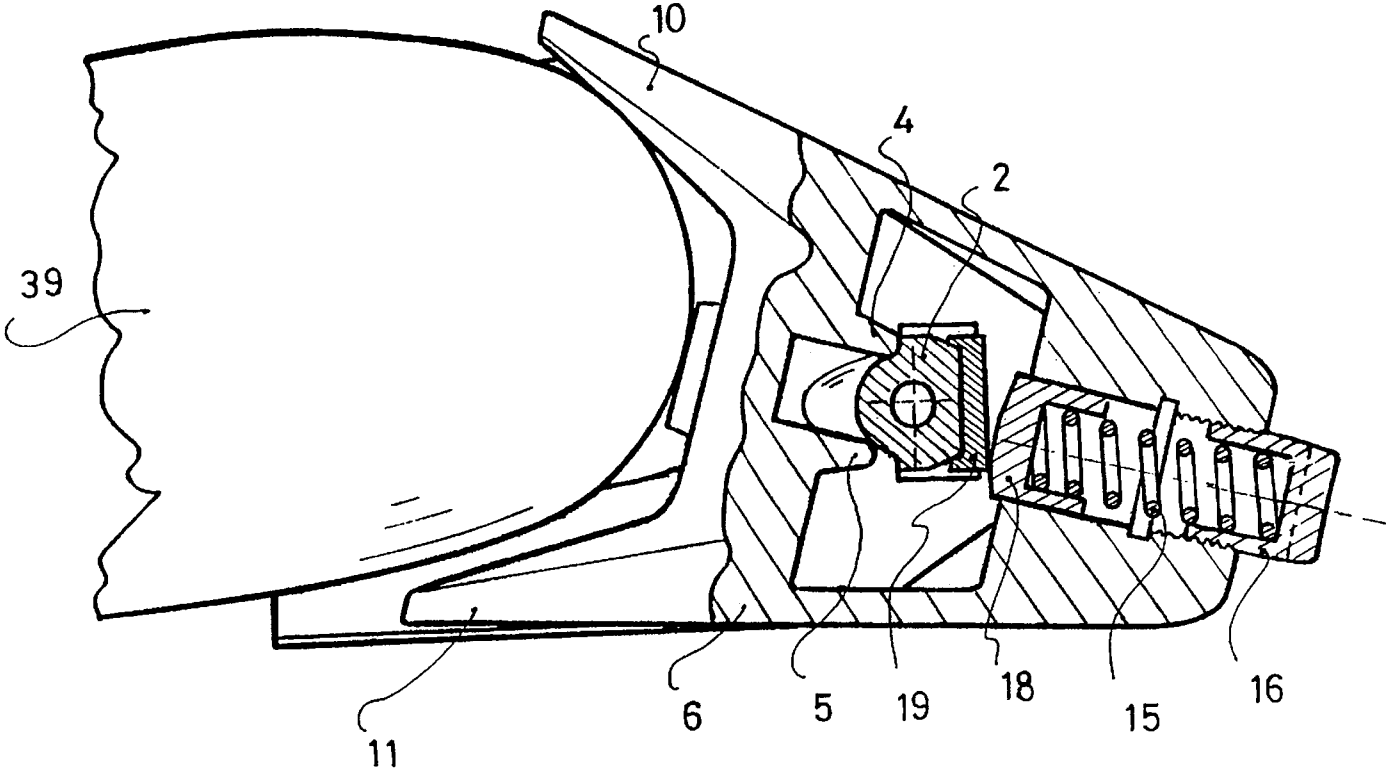
Fig. 8
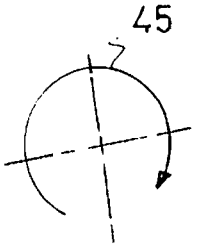

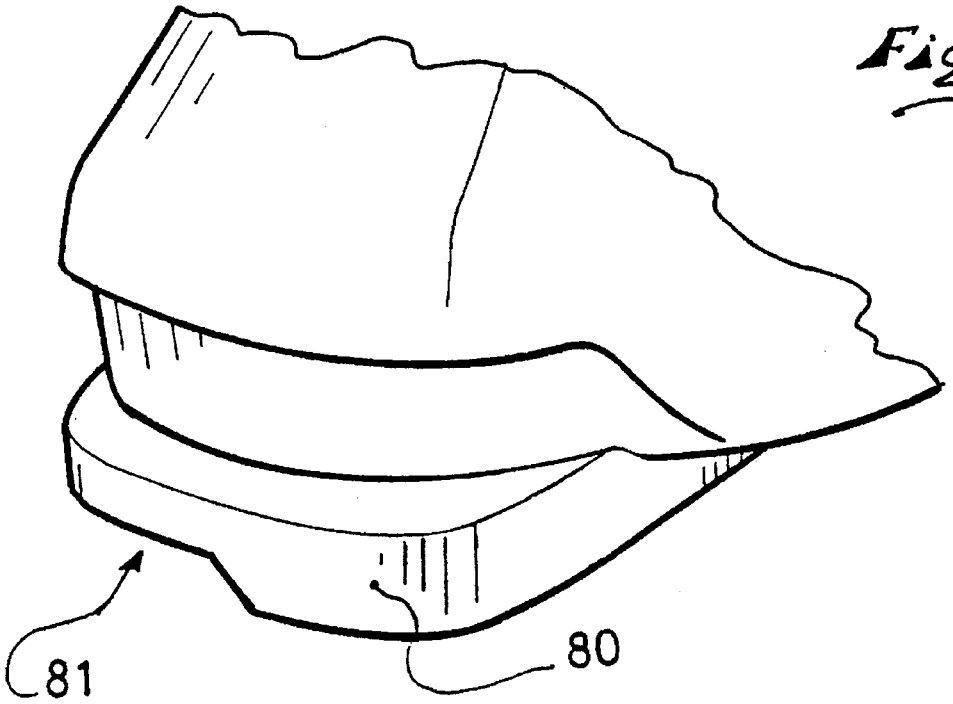
Fig: 14
Fig: 15
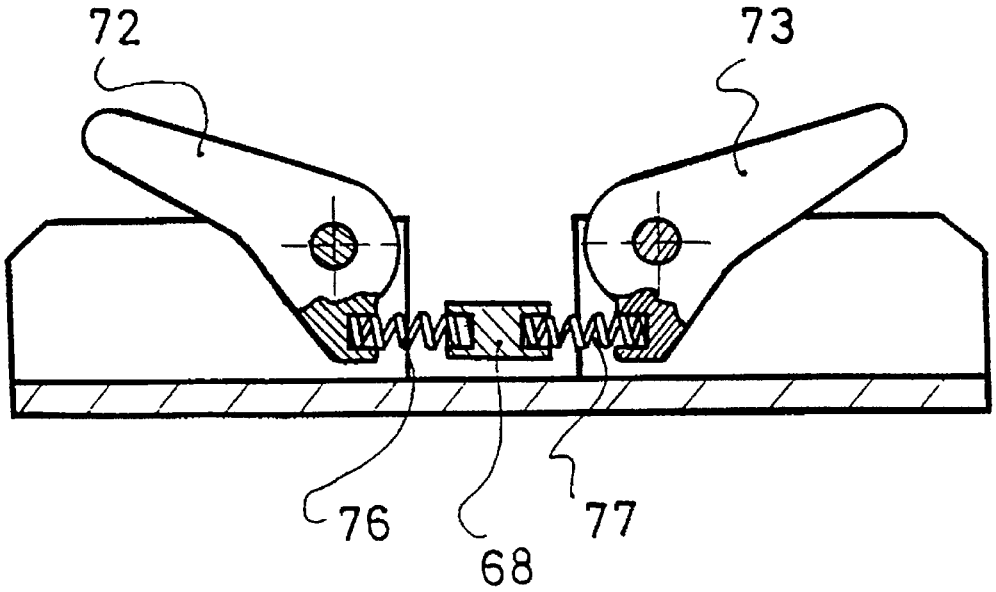

BOOT-RETENTION ELEMENT ASSEMBLY, PARTICULARLY FOR SKIING

BACKGROUND OF THE INVENTION

1. Field of the Invention

The invention relates to an assembly of a shoe and a retention element adapted to retain the leg of an athlete on a gliding board, and particularly the leg of a skier on a ski.

The invention likewise relates to a shoe and to a retention element of the assembly taken individually.

2. Description of Background and Material Information

In the case of alpine skiing, it is known to retain a shoe supported on the ski by means of a front retention or binding element and a rear retention or binding element which retain front and rear tips of the boot. These two binding elements comprise a jaw carried by a body. The jaw is movable in response to the biases of the boot against the return force of a spring which opposes displacement of the boot.

The rigidity of the spring is adjustable, in a manner such that the boot is freed from the binding element in response to a bias exceeding a predetermined bias threshold. This threshold beyond which the jaw lets the boot escape is normally referred to as a release threshold.

In order to be able to utilize boots with different binding or retention elements available on the market, the shape of the front and rear tips of the boot has been standardized. In the ISO standards system, the standard in effect is referred to as ISO 5355. As to the binding elements, they are adapted to be compatible with standardized zones of the boot and to assure the release of the boot at predetermined release values.

At the front, a boot is retained by a front binding element whose jaw is movable at least laterally towards the interior or exterior of the foot, which corresponds to a torsional bias on the leg of a skier.

Currently available bindings have a release threshold which is equal during movement towards both the interior and the exterior. Yet, it is known that the knee of the skier, which is biased during a torsional fall, is more fragile with respect to an interior rotation of the foot than in the case of rotation towards the exterior.

To take this into account, binding elements have been proposed which have a release threshold which varies depending on the direction in which the jaw rocks. Such elements are described, for example in French Patents 1503847, 1503848, and 1503849, and in German Patent Application No. 1807074.

The major disadvantage of this type of apparatus is that it requires a pairing between the shoes and the skis, i.e., the right and left skis must necessarily be identified and the skier must put the right ski on the right boot and the left ski with the left boot. He must certainly not reverse the skis when they are put on; otherwise, the reverse effect is obtained which can have serious consequences. Yet, according to the standards, the tips of the boot are symmetrical with respect to a vertical median plane. As a result, there would normally be no presumptive reason for distinguishing and identifying ski equipment as being right and left. However, for these particular bindings, it is thus necessary for the skier to pay attention to the manner in which he lines up his skis for putting them on. This represents a major risk of confusion and danger.

SUMMARY OF THE INVENTION

The problem posed by the invention is to improve the protection of the skier. It comprises improving this effect of the variation in release threshold as a function of direction of the torsional bias.

The invention proposes resolving this problem and obtaining this effect regardless of the manner in which the skis are put on the boots, left or right.

The problem is resolved by the assembly of a shoe and a binding element such as may be described in the claims below.

The problem is further resolved by the binding element such as is defined individually, and by the boot such as it is defined individually, and by the pair of boots such as it is defined below.

According to the invention, the retention element is provided to cooperate with a specially adapted boot which is equipped with a reference indication which is different depending on whether it is a right boot or a left boot. It is known that while it is possible to exchange right and left skis because the tips of the boots are symmetrical, it is not reasonable to expect that right and left boots can be put on the wrong feet.

The retention element has a means piloted by sensors to imbalance the release thresholds at will from one side or the other as a function of the information carried by the boot and sensed by the sensors.

The information carried by the reference indications indicates to the binding element if the boot engaged is a right boot or a left boot. These references are identified by sensors of the retention element. Depending upon the position of the sensors, the means of the retention element render the release threshold stronger or weaker on one side or the other to facilitate release of the boot in the direction of torsional bias of the leg where the knee is the weakest. In the other direction of torsion, the maintenance of the boot is assured more rigidly than in the first direction. One thus improves the protection of the skier and one diminishes ill-timed releases, because the binding element reacts in a different manner depending upon whether the foot pivots towards the exterior or the interior. According to the invention, the retention element reacts automatically, such that it is not necessary to identify the skis as being right and left, nor to pair a ski with a boot. Thus, one avoids any risk of reversing the skis.

According to a second preferred characteristic, the sensors of the retention element are adapted to have no effect on the mechanism of the jaw in the case where a boot without a reference is engaged, or the sensors act in the same fashion in the two directions of displacement of the jaw, in a manner such that the retention element remains compatible with a standard boot, by assuring a symmetrical release of the boot.

According to another preferred secondary characteristic, the boot has a reference which is adapted not to disturb the operation of a standard binding element, i.e., an element which is not equipped with an identification means nor a control means.

BRIEF DESCRIPTION OF THE DRAWINGS

The invention will be better understood with reference to the description below and the annexed drawings which form an integral portion thereof, in which:

FIG. 6 is a partial top view of a front of a boot compatible with the retention element of the preceding figures.

FIGS. 7 and 8 illustrate the operation of the apparatus.

FIGS. 9 and 10 are alternative embodiments of the boot.

FIG. 14 is a perspective view of the front of a boot adapted to cooperate with the retention element of FIG. 12.

FIG. 15 is a cross sectional view at the level of the sensors.

DETAILED DESCRIPTION

Figure 1:
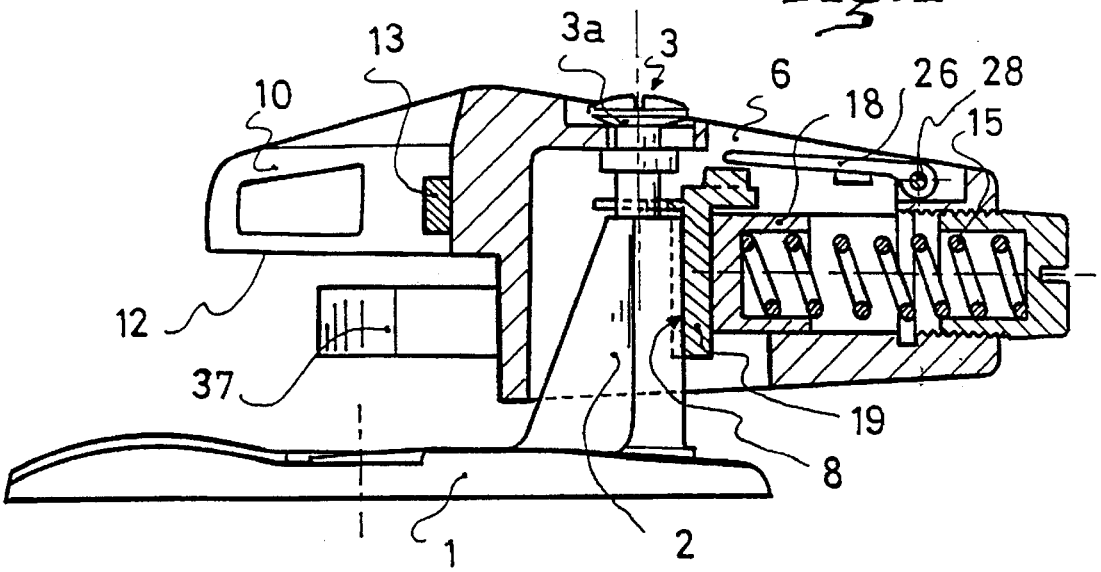
FIG. 1 shows a side view and in cross section of a retention element according to one non-limiting way of performing the invention.
Figure 2:
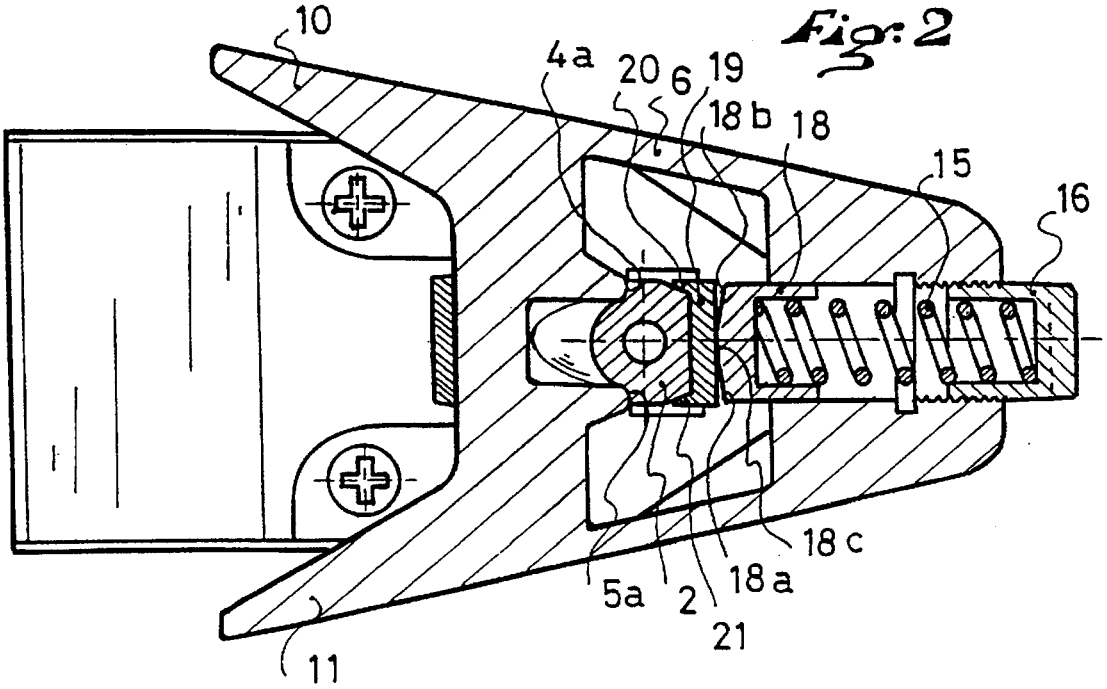
FIG. 2 illustrates a top view and in partial cross section the binding element of FIG. 1.
Figure 3:
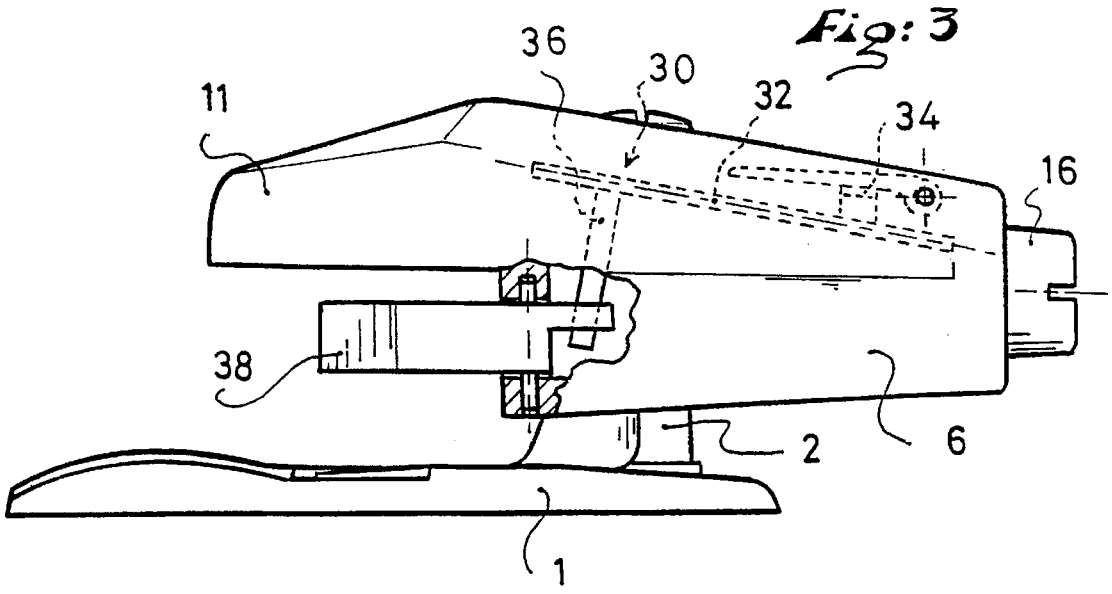
FIG. 3 is a side view of the retention element and shows more particularly an identification sensor.
Figure 4:
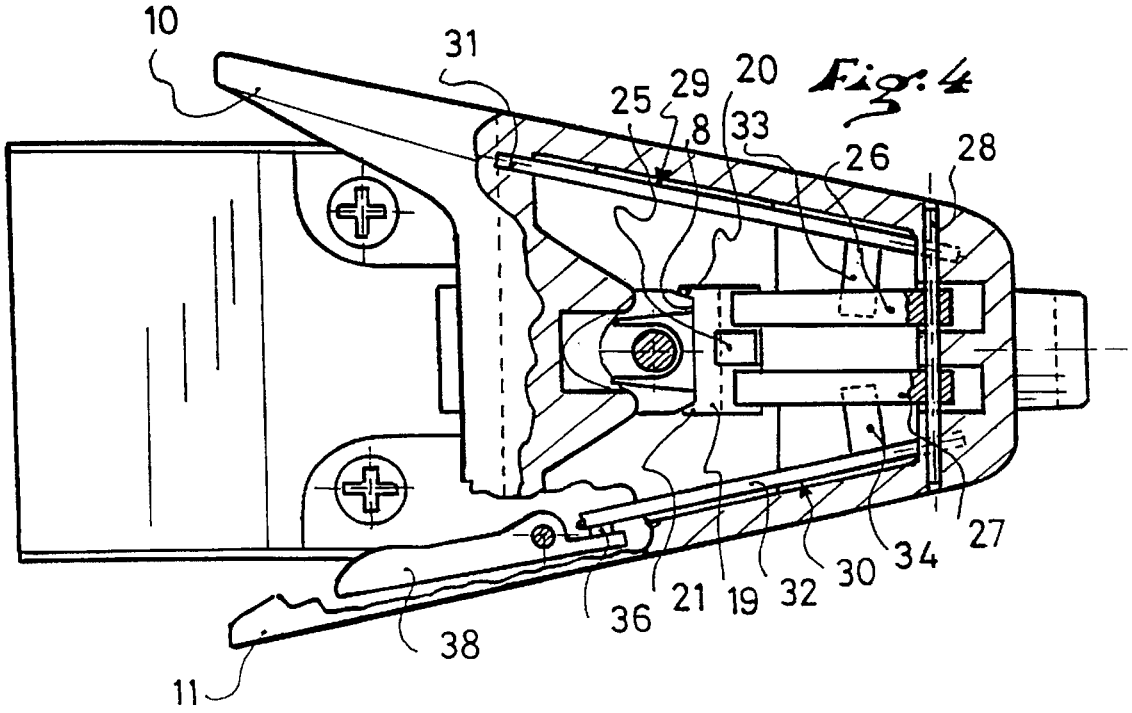
FIG. 4 is a top view in cross section which illustrates more particularly the linkage between the identification sensors and the return mechanism of the jaw.

The retention element illustrated in the Figures, by way of non-limiting illustration of the invention, is generally disclosed in published French Patent Application No. 2517214, the disclosure of which is hereby incorporated by reference thereto.

This element comprises a base 1 adapted to be affixed to the ski by an appropriate means, for example screws.

The base carries a pivot 2 topped by a screw 3. In a known manner, body 6 of the binding element is in a way connected on to the head of the screw, and by tightening the screw more or less in the pivot, it is possible to adjust the height of the body with respect to the ski. The vase and screw form on the rear two support lines against which body 6 of the retention element is supported. In a known manner, the support lines converge towards the head of the screw, and the body rests on the pivot through three zones or points, two identified zones 4*a* and 5*a* located in the lower portion of the pivot, and the head 3*a* of the screw 3. It is these three zones which form, taken two by two, the two converging lines of support.

On its front surface, the pivot 2 of the base has a transverse surface 8 against which the return spring 15 of the retention element exerts its action.

Towards the rear, the boy 6 has a retention jaw for engaging the boot. The jaw comprises two wings 10 and 11 which form with the body a monoblock assembly, or quasi monoblock assembly, if one takes into account the means allowing for the adjustment of angular opening of the wings. These means are known and are not referenced in the drawings.

Wings 10 and 11 assure the lateral retention of the boot. Because of their position, wings 10 and 11 retain the boot by what one refers to as a vamp grip. The standardized tip of the boot has in effect in a known manner a lower sole portion, topped by an upper portion which forms the base of the vamp. It is on this latter portion that wings 10 and 11 exert their action. Naturally, this is not limiting, and the other way of gripping the tip, referred to as a sole grip is likewise possible. The vertical retention is assured as to itself by the lower portion of the wings which furnish a support surface to the upper portion of the sole. This is not in any way limiting.

The jaw also comprises a central support point 13 against which the most advanced portion of the vamp of the boot is carried.

Towards the front, the binding element has an elastic return mechanism of the body into the aligned position with the vertical and longitudinal median plane defined by the longitudinal direction of the ski.

This mechanism comprises in a known manner a spring 15 seated in a longitudinal recess of the body which is closed by a threaded plug 16. One end of the spring bears on this plug whose tightening makes it possible to adjust the stiffness of the retention element, i.e., the initial compression of spring 15.

The other end of the spring acts on the surface 8 described above, by means of a piston 18, and intermediate plate 19 which will be described below. Preferably, the piston has on its support surface two lateral bevels 18*a* and 18*b*, which are slightly inclined. These bevels are visible more particularly in FIG. 5. Thus, the support surface of the piston has a central surface 18*c* of triangular shape and two lateral bevels 18*a* and 18*b*.

In a known manner, spring 15 maintains the body in a stable position aligned with respect to the median plane. Under the effect of a lateral bias of the boot, the jaw and the body tend to pivot around one or the other support lines of pivot 2, against the return force developed by the spring. In the case of excessive bias, the amplitude of rotation of the jaw becomes sufficient to allow for the release of the boot. The bias threshold beyond which the jaw releases the boot is referred to as the release threshold. This threshold depends directly on the nature of the spring and its initial compression.

The retention element has means to vary the release threshold of the retention element at will from one side or the other. These means act on the release thresholds to the right and to the left as a sort of rocker to vary one with respect to the other. These means will now be described.

In the embodiment shown in the Figures, these means comprise a flat plate 19 which is inserted between piston 18 and surface 8 of pivot 2. Thus, piston 18 is pushed against surface 8 of pivot 2 by means of plate 19.

Advantageously, plate 19 laterally presents two flanges 20 and 21 whose spacing is substantially equal to the width of surface 8, in a manner such that in the aligned position, the plate is freely nested on surface 8 and pressed against this surface. Plate 19 rests on one or the other flange in the case of pivoting of the plate with respect to the pivot. Furthermore, in its upper portion, the plate has a return 22 which assures the vertical maintenance of the plate by taking support against piston 18.

The support surface of plate 19 on pivot 2 is greater than the support surface of piston 18 on plate 19.

Means make it possible to guide the displacement of the plate 19, by associating it either with the pivot 2 or the body 6 of the retention element.

Thus, the plate has in its upper portion a stopper 25 which projects, and is aligned with the median plane. On each side of the stopper there is a movable latch 26 and 27 mounted on a transverse journal 28 carried by the body. Each latch is movable between a lower position where it blocks the relative displacement of the stopper on the side where the latch is located, and an upper position where it allows the relative displacement of the stopper. During a rotation of the body, if the plate is retained by a latch, it is forced to pivot with the body. If the latch in question is raised to the upper position, the plate remains pressed against the pivot.

The latches 26 and 27 are controlled by rocker arms 29 and 30 which are seated in the body. The rocker arms are shown in the form of shafts 31 and 32 which are approximately oriented along a longitudinal direction, and carried at each of its ends by body bearings.

The shaft carries flaps 33 and 34 which are engaged under the latches 26 and 27 in the manner so as to be capable to lift them by a rotation of the shaft.

Shafts 31 and 32 also carry flaps 35 and 36 which are oriented downwardly. It is these flaps which control the rotation of the shafts.

The flaps are driven by two sensors 37 and 38 which are shaped as fingers positioned under laterally opposed wings 10 and 11 and journalled around substantially vertical axes.

The sensors have in front of their journal axis a small arm through which they act on the rocker arms 29 and 30.

Preferably, one or more springs (not shown) elastically return the latches in individual fashion, the latches into the lower position where they block the stopper 25. This spring or springs act likewise directly or indirectly on the rocker arms and the sensors to elastically return these sensors to a position where they have a tendency to close towards one another.

Furthermore, preferably, flaps 35 and 36, or flaps 33 and 34, are relatively flexible.

Sensors 37 and 38 are adapted to sense the boot at the front of the sole. In the absence of the boot, they leave between them a smaller opening than the width of a standardized sole.

The boot adapted to cooperate with the retention element, which is a special boot, has a reference which identifies it as being a right boot or left boot. In the following case, this reference is active, i.e., it acts in a mechanical manner on the sensors of the binding element to inform the element whether the special boot which is engaged is the right or left.

The front part of a special boot 39 adapted to cooperate with the retention element is shown in FIG. 6. The boot has a sole front 40 of which one lateral portion 41 has been reduced with respect to the other lateral portion 42. The front portion of the sole is therefore no longer symmetrical. Taking into account the configuration of the retention element, the boot shown in FIG. 6 with a reduced lateral portion on the sole is a left boot. It is self-evident that the corresponding right boot has on the right of the sole a reduced lateral portion.

The lateral portion 41 has been reduced in a manner such that when the boot is engaged in the jaw, sensor 37 positioned on its side is not displaced. On the contrary, sensor 38 positioned on non-reduced side 42 of the sole is displaced. This displacement causes the rotation of the rocker arms 30 and the lifting of the latch 27. The latch 26 remains on the contrary lowered.

FIG. 7 illustrates the mode of operation of the retention element under the effect of a bias leading to the opening of the jaw towards the interior of the foot. This bias causes on the leg of the skier, more particularly at the level of the knee, a torsion whose direction is schematically shown by arrow 44. As a result of this torsion, the foot tends to pivot towards the exterior. It is in this direction of torsion that the knee is most resistant for a left leg.

As has been previously described, the latch 26 is lowered, such that the plate 19 is linked to the body for this direction of rotation. Body 6 drives plate 19 in rotation, the plate spaces itself angularly from the pivot, which causes the sliding of the piston 18 and the compression of spring 15. The release threshold for this direction of rotation of the body is defined by the force that the boot must overcome to cause a pivoting of the body which allows it to escape from the jaw. This force depends upon the compression of the spring, and thus on the extent that the piston must undergo until release.

FIG. 8 shows boot 39 biasing the retention element in the other direction of pivoting of the body. This direction corresponds to a torsion of the leg schematically shown by arrow 45. For a left leg, the knee is more fragile in this torsional direction than in the preceding direction.

For this direction of rotation of the body, the latch 27 has been raised because the sole of the boot has pushed sensor 38.

The plate 19 is therefore not forced to accompany the rotation of the body, and it remains pressed against surface 8 of body 2. The body laterally drives the piston which slides along the front surface of the plate 19. This causes the compression of the spring, but this compression is more moderate than in the preceding case, taking into account the dimensions of the support surface of the piston, and taking into account also the lateral bevels 18*a* and 18*b*. The extent of movement of the piston necessary to bring the jaw and the body to release the boot is thus less than in the preceding case. The release of the boot is thus easier on this side.

It must be understood that the activation of the sensors and the latches requires very low energy, such that these elements have only a very small impact on the release of the boot.

In a preferred manner, if a standard boot is engaged in the retention element which has been described, the two sensors 37 and 38 are pushed, which lifts the two latches 26 and 27. The retention element has a release threshold which is substantially identical to the two directions of bias of the boot. For the construction described, these thresholds correspond to the weakest preceding threshold. However, it could be otherwise.

Conversely, if the special boot 39 is engaged in a standard retention element operating by a vamp grip, i.e., wherein the jaw retains the tip of the sole of the boot through the vamp portion, there is no change in the linkage between the boot and its retention element. If the retention element acts through a sole grip, an adjustment in the opening of the wings of the jaw will certainly be necessary because the sole of the special boot will have been locally reduced.

To overcome this, FIG. 9 shows an alternative embodiment of the boot according to which the reduced zone of the boot which avoids the displacement of the sensor is formed by a groove 48 formed for example at mid-height of the sole, at the level of an angle. This groove does not modify the exterior general contour of the sole, so that such a boot is also compatible with the retention elements for gripping a sole.

For the boot shown in FIG. 9, the sensor will preferably be a rod positioned at the level of the groove, but of diameter smaller than its width. The rod can preferably be flexible.

FIG. 10 shows another alternative embodiment of the boot according to which the sole has in its lower portion a cutout 50. However, in its upper portion, the sole keeps a standardized contour, and thus the boot remains compatible with traditional retention elements.

The construction which has just been described is not limiting and numerous alternatives are possible.

In particular, for the preceding construction, it is possible to reverse the direction in which the latches are activated by the sensors, i.e., a sensor could control not the lifting, but the lowering of a latch.

Figures 5, 5A:
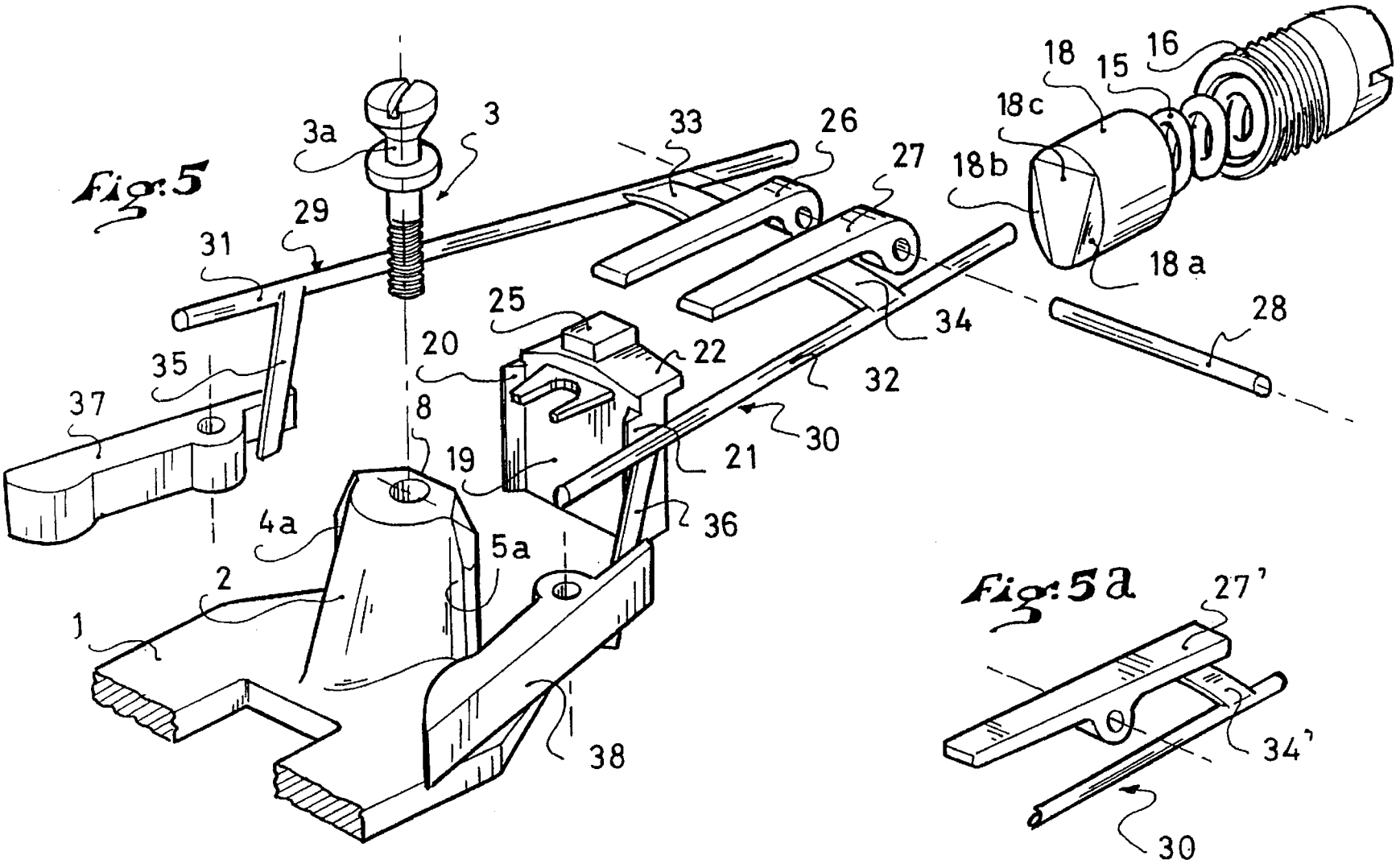
FIG. 5 is an exploded view which shows the kinematic chain of the linkage elements between the sensors and the return mechanism of the jaw.
FIG. 5*a* schematically shows an alternative embodiment.

FIG. 5*a* schematically illustrates such a situation. Flap 34' of rocker arm 30 acts on latch 27' in front of its transverse journal axis. At rest, latch 27' leaves the plate free. If the sensor which controls latch 27' is activated by the sole of the boot, it lowers towards the plate the active portion of the latch. The plate must then follow the movement of the body. In this case, if one engages a standard boot, the two sensors are activated. The plate displaces with the body in the two directions of rotation of the body. If a special boot is engaged, a single sensor is activated. On the side where the sensor is not activated, one lowers the release threshold of the binding element. One must reverse in this case on the two boots, the lateral edges of the sole which are reduced. An effect of this variation is that activation of a sensor causes not diminution, but the increase of one of the release threshold.

Figure 11:
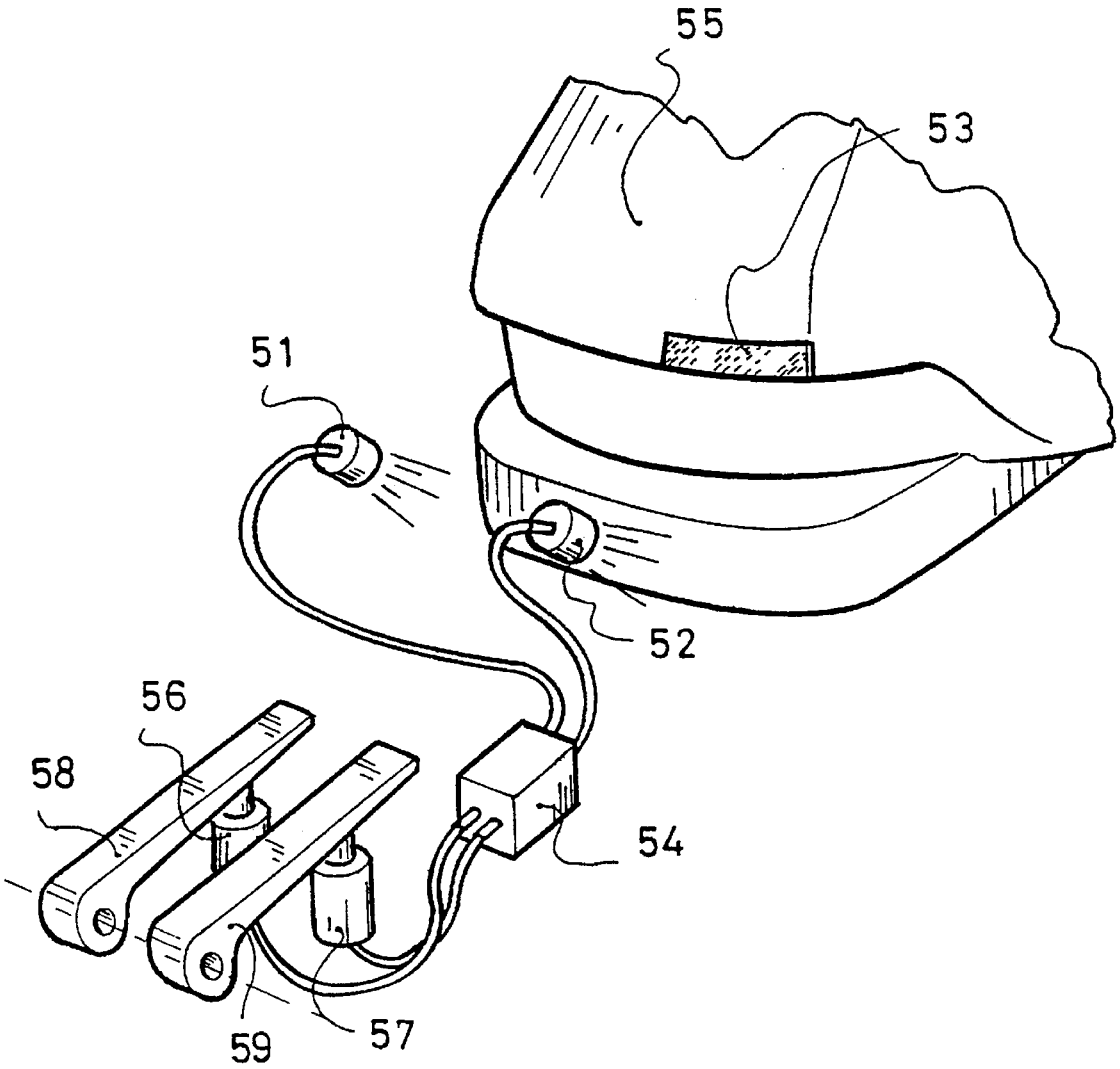
FIG. 11 illustrates in schematic fashion an alternative embodiment.

FIG. 11 schematically illustrates an alternative embodiment. In this embodiment, sensors 51 and 62 operate optically and detect in a differential manner an optical mark 53 on boot 55, for example a graphic or a color mark positioned on one side of the boot.

The sensors are connected to an electronic or electric control unit 54 which controls one or the other of two electromagnets 56 and 57 activating one and/or the other of the two latches 58 and 59.

Optical mark 53 has no effect on the mechanical linkage between the boot and the retention element, such that the special boot remains compatible with a standard retention element.

For this embodiment, the detection is carried out for example by photoelectric cells, but they could also be performed by field effect, or any other appropriate means.

Figure 12:
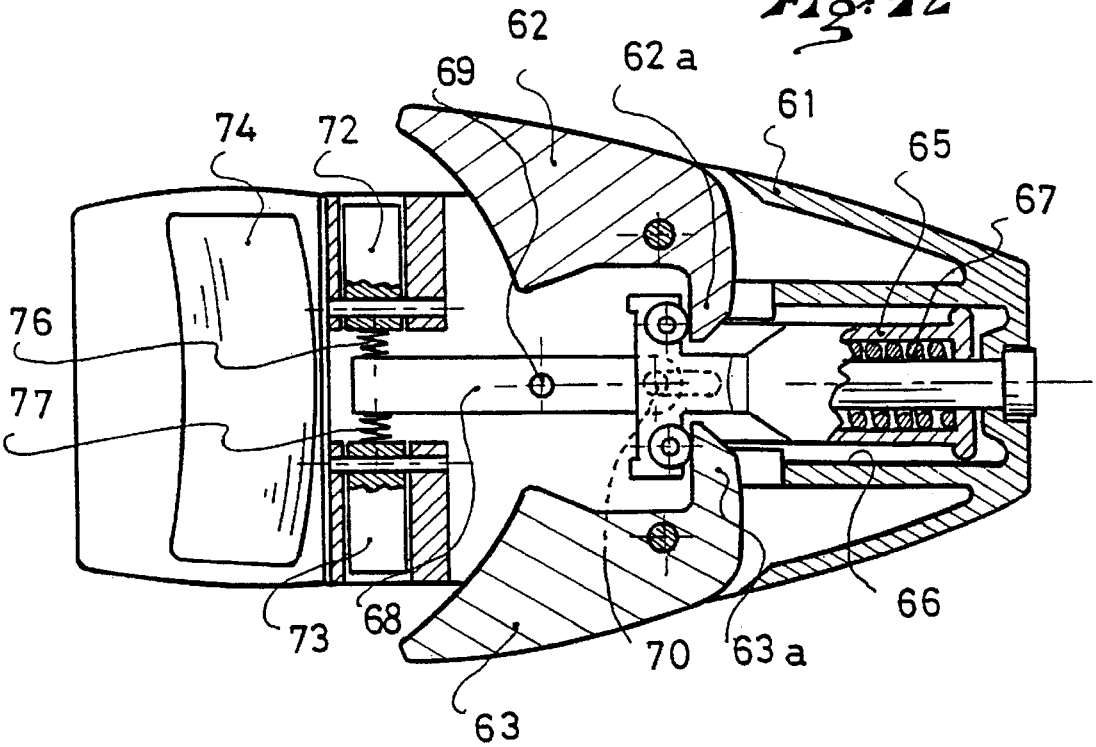
FIG. 12 illustrates a top view and in cross section a retention element according to an alternative embodiment of the invention.

Another embodiment is shown in FIG. 12. The structure of the retention elements shown is known in large measure from published French Patent Application No. 2640516, the disclosure of which is hereby incorporated by reference thereto.

The retention element has a body 61 adapted to be affixed to the ski. The body carries two wings 62 and 63 for retention of the boot, journalled to the body in an independent manner around substantially vertical axes.

The wings extend beyond their journal axis through a small arm 62*a*, 63*a*, which is supported on a piston 65 seated in a longitudinal recess 66 of the body. In a known manner, the piston carries at the top of its rear portion two shoulders against which small arms 62*a* and 63*a* of the wings are carried. A spring 67 opposes by virtue of its compression the displacement of the piston caused by an opening of one or the other of the wings.

Piston 65 is guided along housing 66 in its front portion, for example, by means of projecting nipples. To the contrary, its rear portion has a possibility of lateral back and forth movement within housing 66.

The lateral back and forth movement of piston 65 is guided by a longitudinal rail 68. The rail is journalled around a vertical axis 69 carried by the base of the body, and it is connected to the piston 65 by a vertical pin 70. For example, as is shown in the Figures, pin 70 is carried by the rail, and it moves in a longitudinal slot of piston 65, whose length corresponds approximately to the longitudinal extend of the piston.

Rail 68 can oscillate angularly in a horizontal plane around axis 69, which moves the rear end of the piston from one side or the other of the median plane. This serves to vary the length of the arm of the lever with which each of the wings biases the piston. For example, if the rear end of the piston is displaced towards the top of the FIG. 12, wing 63 will act on the piston with a longer lever arm, and wing 62 with a shorter lever arm. The boot will be more easily freed by wing 62 than by wing 63. It must be noted that according to the present embodiment, the modification of the release thresholds of the retention element is translated on the one side by a diminution, and on the other side by an increase in the release threshold.

To facilitate the lateral displacement of the rear of the piston preferably, the support of the small arms 62*a* and 63*a* of the wings occurs by means of a roller carried by the shoulders of the piston.

The oscillation of rail 68 is controlled by the sensors which are adapted to detect an asymmetry of the boot.

The embodiment illustrated shows two sensors 72 and 73 positioned slightly in front of support element 74 of the boot. Each sensor extends transversely on one side of the median plane, and it is journalled around a horizontal and longitudinal axis carried by the base of the retention element. These journal axes are situated in the vicinity of the vertical and longitudinal median plane. The rear end of the rail is engaged between the lower portion of the two sensors, and a compression spring 76 and 77, or any other compressible means, is inserted along a transverse direction between the end of the rail and each of the sensors.

Under the effect of the springs, and in the absence of a boot, the sensors 72 and 73 are raised above the horizontal. Possibly, an abutment (not shown) limits their upward movement. As a result, the rear end of the rail 68 is maintained in alignment of the median longitudinal plane. If one of the sensors if lowered, for example, sensor 73, rail 68 will be pushed in the direction of the other sensor by spring 77. This oscillation of the rail will offset the piston and produce the change of the lever arms of the wings previously described.

FIG. 14 shows the front of a boot, in this case a special boot, adapted to cooperate with the retention elements. The front of sole 80 has over substantially half of its width a cutaway 81 which diminishes locally the thickness of the sole. This cutaway has a depth which is substantially constant and opens downwardly.

Figure 13:
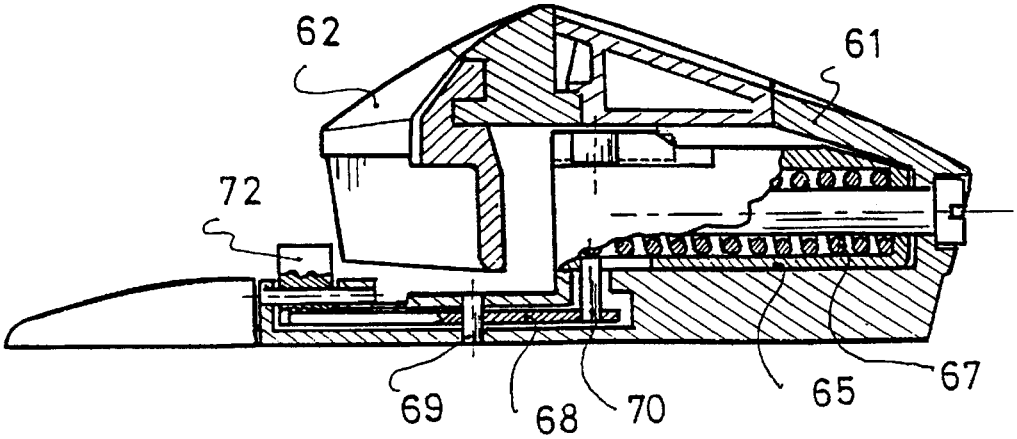
FIG. 13 is a side view and cross section of the retention element of FIG. 12.

When the boot is engaged in the retention element of FIGS. 12 and 13, sensor 73 positioned on the side of the cutout is not lowered. On the other hand, the other sensor 72 is lowered, from which a displacement towards the top of FIG. 12 of the rear end of piston 65 occurs as has been previously described. Wing 62 will oppose a resistance under these conditions to the release of the boot which is less than wing 73.

To obtain a better protection of the knees in the case of a rotation of the foot towards the interior, cutaway 81 is formed as shown in FIG. 14 for a left boot. It is formed on the other side of the sole for a right boot.

The retention element which has been described is nevertheless totally symmetrical, i.e., it is compatible with both the right boot as well as the left boot.

Preferably, if a standard boot is engaged in the retention element of FIGS. 12 and 13, it is the two sensors 72 and 73 which are lowered simultaneously. The two springs 76 and 77 are compressed, and the rail remains in alignment with the longitudinal median plane. Piston 65 remains liekwise aligned with this plane. There is no modification of the lever arms of the wings, and the release threshold of the retention element remains the same for the two sides for release of the boot.

If the boot of FIG. 14 is engaged in a standard retention element, there will be no significant change in the retention conditions of the boot for one or the other modes of retention of the boot, i.e., vamp grip or sole grip.

Numerous other variations are also possible as to the position of the sensors and the identification zones of the boot which they detect. Thus, the identification zones could be situated under the sole, towards the front, the middle or even the rear of the boot, the sensors being positioned accordingly. They could also be positioned on the vamp, above the standardized zone. The reference allowing for the identification of the boot could be a zone which is raised instead of a zone which is hollowed out.

Finally, the invention is applicable to different types of construction of retention elements, in particular, elements having a fixed body and independent jaw signs, elements having a fixed body and jaw wings which are connected in displacement, elements having wings or a jaw whose opening is progressive against a return force of a spring, or those whose opening is controlled by a movable latch.

The invention applies also to the retention elements of the boot which have specific means of compensation or release of the boot in the case of combined front-torsion and rear torsional falls.

The instant application is based upon French patent application 94.08942 of Jul. 13, 1994, the disclosure of which is hereby expressly incorporated by reference thereto, and the priority of which hereby claimed.

Generally speaking, although the invention has been described with reference to a particular means, materials and embodiments, the invention is not limited to those particular means, embodiments and materials which are disclosed and extends to all equivalents falling within the scope of the claims.

What is claimed is:

1. An assembly of a boot and a binding for a boot on a gliding board, said assembly comprising:

a boot comprising:

an end having a tip extending on each side of a longitudinal vertical median plane of said boot;

a reference identifying said boot as a left boot or a right boot;

a binding comprising:

a base adapted to be affixed to the gliding board;

a retention jaw supported by said base, said jaw having a construction adapted to engage said tip of said boot in a retention position in alignment with a longitudinal vertical median plane of said binding;

a return spring operatively connected to said retention jaw to bias said jaw to said retention position, said jaw being supported by said base for movement from said retention position against a return force of said return spring in response to movement of said tip of said boot laterally to one or the other side of said longitudinal vertical median plane of said binding from said retention position of said jaw to a release position upon a bias exerted by said tip of said boot equal to or greater than a release threshold force;

sensors for sensing said reference to identify said boot as either a left or a right boot;

at least one rocking member movable to a predetermined position in response to said sensing of said reference;

a linkage connecting each of said sensors and said at least one rocking member to move said rocking member to said predetermined position in response to said sensing of said reference, said predetermined position of said rocking member modifying said release threshold force for at least said one or the other side of said longitudinal vertical median plane of said binding.

2. An assembly according to claim 1, wherein:

said reference includes a mechanical reference and said sensors are positioned for mechanical movement by said mechanical reference.

3. An assembly according to claim 1, wherein:

said reference is optical and said sensors are photoelectric reading cells.

4. An assembly according to claim 2, wherein:

said mechanical reference comprises a portion of one lateral side of said boot retracted with respect to a symmetrical portion positioned on an opposite lateral side of said boot.

5. An assembly according to claim 4, wherein:

said portion of one lateral side of said boot is a portion of a vamp of said boot.

6. An assembly according to claim 4, wherein:

said portion of one lateral side of said boot is a portion of a sole of said boot.

7. An assembly according to claim 2, wherein:

said mechanical reference comprises a groove extending within a standardized contour of said end of said boot.

8. An assembly according to claim 2, wherein:

said mechanical reference comprises a cutout extending within a standardized contour of said end of said boot.

9. An assembly according to claim 2, wherein:

said sensors comprise a sensor positioned on either side of said longitudinal vertical median plane of said binding, each of said sensors being positioned to cooperate with one of said retracted portion of said boot and said symmetrical portion of said boot.

10. An assembly according to claim 9, wherein:

said sensors, said linkage, and said at least one rocking member are movable to increase said release threshold force.

11. An assembly according to claim 9, wherein:

said sensors, said linkage, and said at least one rocking member are movable to decrease said release threshold force.

12. An assembly according to claim 9, wherein:

said sensors, said linkage, and said at least one rocking member are movable to increase said release threshold force for a release movement of said boot toward one side of said longitudinal vertical median plane of said binding and to decrease said release threshold force for a release movement of said boot toward an opposite side of said longitudinal vertical median plane of said binding.

13. A binding for use with a boot on a gliding board, the boot having an end with a tip extending on each side of a longitudinal vertical median plane of the boot, a reference identifying the boot as a left boot or a right boot, said binding comprising:

a base adapted to be affixed to the gliding board;

a retention jaw supported by said base, said jaw having a construction adapted to engage said tip of said boot in a retention position in alignment with a longitudinal vertical median plane of said binding;

a return spring operatively connected to said retention jaw to bias said jaw to said retention position, said jaw being supported by said base for movement from said retention position against a return force of said return spring in response to movement of said tip of said boot laterally to one or the other side of said longitudinal vertical median plane of said binding from said retention position of said jaw to a release position upon a bias exerted by said tip of said boot equal to or greater than a release threshold force;

sensors for sensing said reference to identify said boot as either a left or a right boot;

at least one rocking member movable to a predetermined position in response to said sensing of said reference;

a linkage connecting each of said sensors and said at least one rocking member to move said rocking member to said predetermined position in response to said sensing of said reference, said predetermined position of said rocking member modifying said release threshold force for at least said one or the other side of said longitudinal vertical median plane of said binding.

14. A binding according to claim 13, said binding being adapted for use with a boot wherein the reference includes a mechanical reference comprising a portion of one lateral side of the boot retracted with respect to a symmetrical portion positioned on an opposite lateral side of the boot, and wherein:

said sensors are positioned for mechanical movement by engagement with the mechanical reference of the boot; and said retention jaw comprises a pair of laterally opposed wings, said sensors comprise a sensor positioned under each of said wings.

15. A binding according to claim 14, wherein:

said wings are fixed against movement relative to each other.

16. A binding according to claim 13, further comprising:

a pivot upwardly extending from said base, said return spring being mounted to exert a force against said pivot;

a body mounted for movement upon said pivot, said spring being housed within said body;

said at least one rocking member comprises a plate interposed between said pivot and an end of said spring, said plate having a stopper;

said linkage comprises two latches, said two latches being carried by said body, said latches being movable between either of two positions, in one of said two positions said latches connect said plate to said pivot and in a second of said two positions said latches connect said plate for movement with said body.

17. A binding according to claim 16, wherein:

said linkage further comprises two rocker arms supported for movement by said body, each of said two rocker arms connecting one of said two sensors and one of said two latches.

18. A binding according to claim 15, further comprising:

a body fixed to said base, said retention jaw comprising two wings supported by said base for movement with respect to said base;

a piston supported by said body for a longitudinal component of movement against said return force of said return spring, said piston being operatively connected to both of said wings for movement of said wings in response to movement of said piston, said piston having an end connected to said rocking member for lateral movement of said end of said piston in response said sensors.

19. A boot for use with a binding on a gliding board, the binding having a base adapted to be affixed to the gliding board; a retention jaw supported by the base, the jaw having a construction adapted to engage a tip of and end of the boot in a retention position in alignment with a longitudinal vertical median plane of the binding; a return spring operatively connected to the retention jaw to bias the jaw to the retention position, the jaw being supported by the base for movement from the retention position against a return force of the return spring in response to movement of the tip of said boot laterally to one or the other side of the longitudinal vertical median plane of the binding from the retention position of the jaw to a release position upon a bias exerted by the tip of the boot equal to or greater than a release threshold force; sensors for sensing a reference of said boot to identify said boot as either a left or a right boot; at least one rocking member movable to a predetermined position in response to the sensing of said reference; a linkage connecting each of the sensors and the at least one rocking member to move the rocking member to the predetermined position in response to the sensing of the reference, the predetermined position of the rocking member modifying the release threshold force for at least the one or the other side of the longitudinal vertical median plane of the binding, said boot comprising:

said end having said tip, said tip extending on each side of a longitudinal vertical median plane of said boot;

said reference identifying said boot as a left boot or a right boot adapted to be sensed by one of said sensors.

20. A boot according to claim 19, wherein:

said reference includes a mechanical reference adapted to move one of said sensors in response to movement of said boot.

21. A boot according to claim 19, wherein:

said reference is optical adapted to be read by a photoelectric reading cell.

22. A boot according to claim 20, wherein:

said mechanical reference comprises a portion of one lateral side of said boot retracted with respect to a symmetrical portion positioned on an opposite lateral side of said boot.

23. A boot according to claim 22, wherein:

said portion of one lateral side of said boot is a portion of a vamp of said boot.

24. A boot according to claim 22, wherein:

said portion of one lateral side of said boot is a portion of a sole of said boot.

25. A boot according to claim 20, wherein:

said mechanical reference comprises a groove extending within a standardized contour of said end of said boot.

26. A boot according to claim 20, wherein:

said mechanical reference comprises a cutout extending within a standardized contour of said end of said boot.

27. A pair of boots comprising a first boot and a second boot, each of said pair of boots comprising a boot according to claim 17, wherein said reference of said first boot is symmetrically positioned along said longitudinal vertical median plane with respect to said second boot.

28. A pair of boots comprising a first boot and a second boot, each of said pair of boots comprising a boot according to claim 20, wherein said mechanical reference of said first boot is symmetrically positioned along said longitudinal vertical median plane with respect to said second boot.

* * * * *